US009027496B2

(12) United States Patent
Zucco et al.

(10) Patent No.: US 9,027,496 B2
(45) Date of Patent: May 12, 2015

(54) WATERCRAFT MOORING STANDOFF

(76) Inventors: Doug Zucco, Belle Vernon, PA (US); Jamie McNally, Fairport, NY (US)

( * ) Notice: Subject to any disclaimer, the term of this patent is extended or adjusted under 35 U.S.C. 154(b) by 178 days.

(21) Appl. No.: 13/613,093

(22) Filed: Sep. 13, 2012

(65) Prior Publication Data

US 2013/0167764 A1 Jul. 4, 2013

Related U.S. Application Data

(60) Provisional application No. 61/535,489, filed on Sep. 16, 2011.

(51) Int. Cl.

| | |
|---|---|
| ***B63B 21/00*** | (2006.01) |
| ***E02B 3/24*** | (2006.01) |
| ***E02B 3/20*** | (2006.01) |
| *B63B 17/00* | (2006.01) |
| *B63B 21/54* | (2006.01) |

(52) U.S. Cl.

CPC ..... *B63B 21/00* (2013.01); *B63B 17/00* (2013.01); *B63B 21/54* (2013.01); *E02B 3/20* (2013.01); *B63B 2021/001* (2013.01)

(58) Field of Classification Search

CPC ..... B63B 21/00; B63B 21/04; B63B 21/08; B63B 21/20; B63B 21/54; B63B 17/00; B63B 2021/001; E02B 3/20

USPC ..... 114/230.1, 230.15, 230.17, 230.18, 114/230.19

See application file for complete search history.

(56) References Cited

U.S. PATENT DOCUMENTS

| | | | | |
|---|---|---|---|---|
| 2,387,352 | A | 10/1945 | Radick | |
| 2,456,839 | A | 12/1948 | Princell | |
| 2,526,162 | A | 10/1950 | Schuelke | |
| 3,183,877 | A | 5/1965 | Benzel | |
| 3,224,404 | A | 12/1965 | De Jong | |
| 3,336,894 | A | 8/1967 | Eisner | |
| 3,492,963 | A | 2/1970 | Kaiser | |
| 3,863,591 | A | 2/1975 | Wild | |
| 3,974,794 | A * | 8/1976 | Kakitani et al. | 114/230.15 |
| 4,656,961 | A | 4/1987 | Hellkamp | |
| 4,697,538 | A | 10/1987 | Day | |
| 4,751,892 | A | 6/1988 | Sechel et al. | |
| 4,775,056 | A * | 10/1988 | Inglis | 211/105.3 |
| 4,781,138 | A | 11/1988 | Hay | |
| 4,817,551 | A | 4/1989 | Matson | |
| 4,977,846 | A | 12/1990 | Landa et al. | |
| 5,499,591 | A | 3/1996 | Chippas | |
| 5,575,234 | A | 11/1996 | Dysarz | |
| 5,634,421 | A | 6/1997 | Velarde | |
| 6,205,944 | B1 | 3/2001 | Dierksen et al. | |
| 6,561,113 | B2 | 5/2003 | Leise | |
| 6,659,033 | B1 | 12/2003 | Donley | |
| 6,851,380 | B1 | 2/2005 | Khoury et al. | |
| 6,910,435 | B2 * | 6/2005 | Hadcroft et al. | 114/230.15 |
| 7,066,102 | B1 | 6/2006 | Tossavainen | |
| 7,100,527 | B2 | 9/2006 | Munro | |
| 7,293,519 | B2 * | 11/2007 | Montgomery et al. | 114/230.1 |
| 8,215,256 | B2 * | 7/2012 | Montgomery et al. | 114/230.1 |
| 8,499,709 | B2 * | 8/2013 | Lee et al. | 114/230.19 |

* cited by examiner

*Primary Examiner* — Daniel V Venne
(74) *Attorney, Agent, or Firm* — Basch & Nickerson LLP

(57) ABSTRACT

A portable bracket is removably attached to a structure, such as a tree, for the purpose of relieving the strain on a hunter who is holding and aiming their firearm. A bracket comprising a back plate and a horizontal plate is secured to a tree using a strap and binder arrangement. The firearm support is portable and lightweight and maybe useful for other purposes within a campsite, such as holding a lantern and a like.

2 Claims, 6 Drawing Sheets

WATERCRAFT MOORING STANDOFF

PRIORITY INFORMATION

The present application claims priority, under 35 U.S.C. §119(e), from U.S. Provisional Patent Application Ser. No. 61/535,489, filed on Sep. 16, 2011. The entire content of U.S. Provisional Patent Application Ser. No. 61/535,489, filed on Sep. 16, 2011, is hereby incorporated by reference.

BACKGROUND

Traditionally, in mooring watercraft to a dock, various types of devices have been developed whereby the most simplistic comprises a rope that is tied between the boat and dock. Unfortunately, such lines do not prevent damaging collisions between the boat and the dock. It is also common that weather conditions; such as rough water, turbulent winds, and tidal changes; or boat wakes can buffet the boat forcefully against the dock, or even another watercraft. This is apt to cause serious and expensive damage to the boat and/or the dock. Similar damage often results when two or more boats are tied together, commonly referrer to as rafting.

Thus, it is desirable to provide a rigid watercraft standoff which will permit vertical movement of the watercraft only, thereby accommodating the dynamics of the water while preventing damage to the watercraft by maintaining a fixed distance between the watercraft hull and the mooring.

Conventional devices for mooring a recreational watercraft include bumpers or fenders, which may be attached either to the boat or to a dock, to prevent the boat from being damaged by hitting against the dock due to the action of wind, waves, and wakes. However, these bumpers can rub and/or scuff the boat often causing moderate, but permanent, damage to the boat.

In many situations, it is necessary to moor watercraft to a floating dock, where the wave dynamics become intense as the water becomes turbulent with high winds to the point where the dock and the watercraft undulate relative to each, but not necessarily in unison. In such situations, the watercraft could be damaged in the event that the gunwale of the watercraft rises higher than the dock thereby dislocating fenders onto the surface of the dock or in the alternative the watercraft hull becomes lower than the dock, thereby defeating the purpose of the fenders all together and exposing the watercraft to direct contact with the dock.

Other conventional docking/mooring devices include fiberglass or stainless steel poles permanently affixed to docks, to rigid posts that hold watercraft off and away from docks to which the watercraft is secured. Typically, in the cases where a pair of rigid parallel members is attached between the dock and the watercraft, an additional criss-crossed mooring line serves to restrain the watercraft from moving in a direction parallel to the dock.

Therefore, it is desirable to provide a rigid mooring device using one or more rigid members to maintain a consistent horizontal position relative to the dock, without the use of the aforementioned crisscrossed mooring configuration or rigidly mounted members.

It is further desirable to provide a portable mooring device that will keep a boat at a fixed distance from a mooring dock, whether the dock is of the permanent or floating type, and which will allow movement of the boat in only the vertical direction as the watercraft reacts to wave action.

It is also desirable to provide a portable mooring device that can be used in attaching boats side by side, commonly referred to rafting-off.

Furthermore, it is desirable to provide a mooring apparatus that can be used effectively with various types of docks and watercraft, without requiring any alterations to either.

Moreover, it is desirable to provide a mooring apparatus that is portable and conveniently deployed and removed so that casting off a watercraft is readily and safely executed.

It is desirable to provide a mooring apparatus for boaters with very limited leased docking space.

It is also desirable to provide a mooring device for boats which is removable, and which can be used to secure a boat to a dock or another boat using the conventional cleats provided on docks and boats.

It is desirable to provide a multi-purpose pole to be used as a boat hook by a deck mate when navigating about a mooring, or another boat.

It is further desirable to provide a mooring device for boats which can be used to connect two boats stern to bow for towing.

It is desirable to provide a rigid mooring member system, which can be positioned to adapt to a range of lengths of watercrafts, and which can be used with a series of boat cleat configurations and sizes.

BRIEF DESCRIPTION OF THE DRAWINGS

The drawings are only for purposes of illustrating various embodiments and are not to be construed as limiting, wherein.

DETAILED DESCRIPTION

Figure 1:
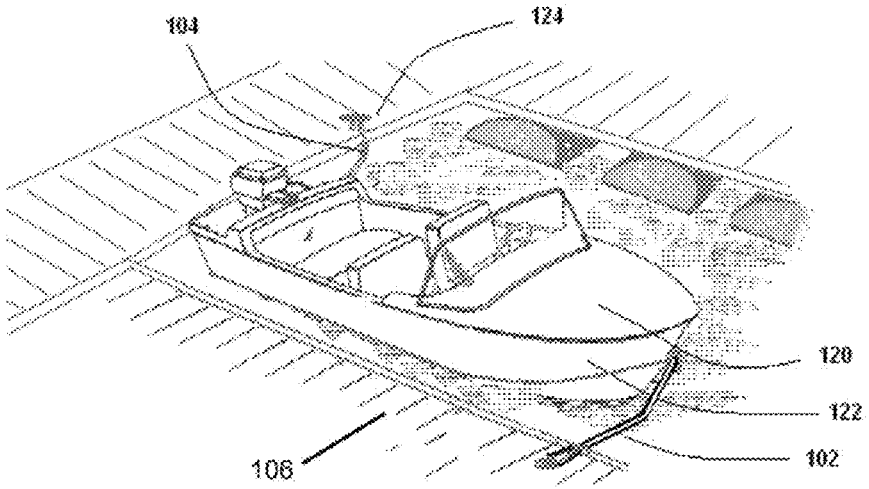
FIG. 1 is an isometric view of the mooring arm in use on a floating finger pier.

For a general understanding, reference is made to the drawings. In the drawings, like references have been used throughout to designate identical or equivalent elements. It is also noted that the drawings may not have been drawn to scale and that certain regions may have been purposely drawn disproportionately so that the features and concepts could be properly illustrated.

FIG. 1 illustrates a watercraft 120 moored at a marina having a multitude of finger piers extending from a central pier. In this illustration, the pier is either buoyant or supported from pylons, depending on water depth and the variability thereof. Rigid mooring member 102, as seen in FIG. 1, provides for a reliable means to secure watercraft 120 using a single, rigidly mounted mooring member on the bow of the starboard side of the watercraft 120 to a finger pier 106 of floating dock 124 in combination with mooring line 104 tying off the port side of the stern of the watercraft 120 to floating dock 124.

The watercraft 120 is restrained from moving, horizontally, towards the finger pier 106 of floating dock 124; however, the watercraft 120 is free to raise and lower with the water level (turbulent or tidal) by using the one rigid mooring member 102 that is able to travel only in the vertical plane.

It is noted that a second mooring line (not shown) tying off the starboard side of the stern of the watercraft 120 to floating dock 124 would restrain the watercraft 120 from moving, horizontally, away from the finger pier 106 of floating dock 124. Moreover, a second mooring line (not shown) or same mooring line 104 tying off the port side of the stern of the watercraft 120 to floating dock 124 in a direction opposite (towards the starboard side of the watercraft) of that illustrated would restrain the watercraft 120 from moving, horizontally, away from the finger pier 106 of floating dock 124.

Figure 2:
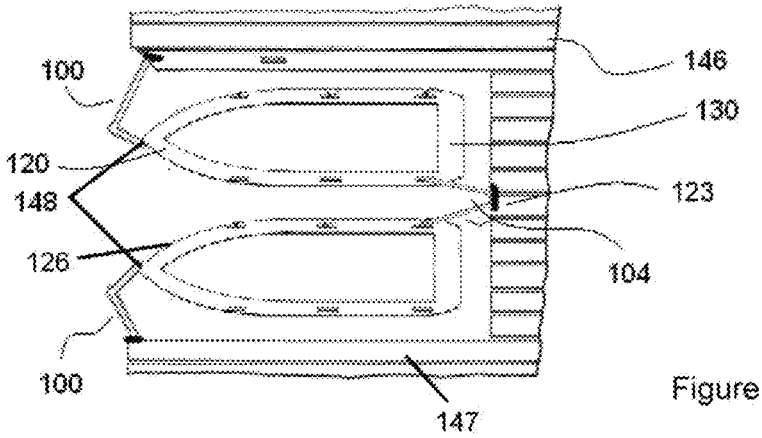
FIG. 2 is a top view of the rigid bow mooring hook and single line at a marina.
Figure 3:
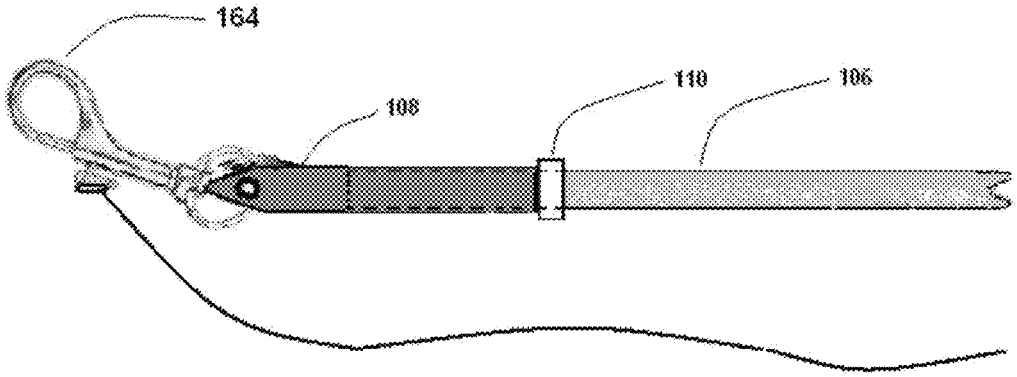
FIG. 3 is a planar view of a rigid bow hook mooring member.

As shown in FIG. 2, watercrafts (120 and 126) are moored alongside finger piers (146 and 147), having a walkway 123 positioned parallel to boat stern 130. Rigid mooring assemblies 100 are removably attached to towing hooks 148 of the bows of watercraft 120 and 126 using a modified snap hook, as illustrated in FIG. 3. A mooring line 104 is used to tie off the stern of each watercraft (120 and 126) to the walkway 123. The mooring configuration of FIG. 2 restrains the watercrafts (120 and 126) from moving, horizontally, towards the finger piers (146 and 147); however, the watercrafts (120 and 126) are free to raise and lower with the water level (turbulent or tidal) by using the rigid mooring members 100 that are able to travel only in the vertical plane.

It is noted that additional mooring lines (not shown) tying off the opposite sides of the stern of each watercraft (120 and 126) to the walkway 123 would restrain each watercraft (120 and 126) from moving, horizontally, away from the finger piers (146 and 147). Moreover, additional mooring lines (not shown) or same mooring lines 104 tying off the stern of each watercraft (120 and 126) to the walkway 123 in a direction opposite (towards the starboard side of the watercraft) of that illustrated would restrain each watercraft (120 and 126) from moving, horizontally, away from the finger piers (146 and 147).

FIG. 3 illustrates, in more detail a rigid mooring assembly which includes a remotely actuated hook 164 having a line attached to open the hook aperture in order to connect to a watercraft's towing hook. The rigid mooring assembly further includes an outer member 108 with slideably inserted inner member 106 to form an adjustable pole.

The rigid mooring assembly also includes a locking ring 110 that engages the outer member 108 and inner member 106 to secure the two members (108 and 106) at the required length to maintain the watercraft at safe distance from the dock.

Figure 4:
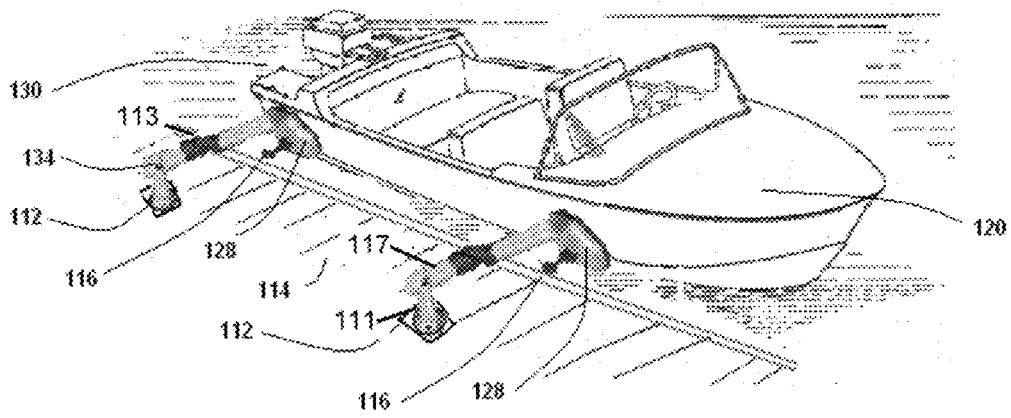
FIG. 4 is an isometric view of two mooring arms affixed to a dockside.

As Illustrated in FIG. 4, a watercraft 120 is moored alongside floating pier 114 using a pair of rigid mooring members. In this illustrated configuration, a rigid dock mount 112 is utilized to connect the rigid mooring members in a pivotal manner to the dock. The dock mount 112 allows the rigid mooring members freedom of movement in a vertical plane, but substantially restricts movement in the horizontal plane (fore and aft motion). The dock mount 112 may include a pin device 134 which provides the pivotal connection of the rigid dock mount 112 to the rigid mooring members.

Optionally, the dock mount 112 may include a horizontal extension arm 117 to provide the freedom of movement in a vertical plane wherein the horizontal extension arm 117 includes a connection mechanism 113 for connecting to the rigid mooring member. This connection mechanism 113 may a pin connection, a threaded connection, or other rigid mechanical connection that securely connects the rigid mooring member to the horizontal extension arm 117.

The rigid mooring members may be connected to the watercraft 120 via a suction cup mechanism 128 having a release mechanism 116. The rigid mooring members may be connected to a location near the stern 130 of the watercraft 120 and a location near the bow 120 of the watercraft 120 to provide negligible fore and aft motion and to keep the watercraft 120 off the pier.

Figure 6:
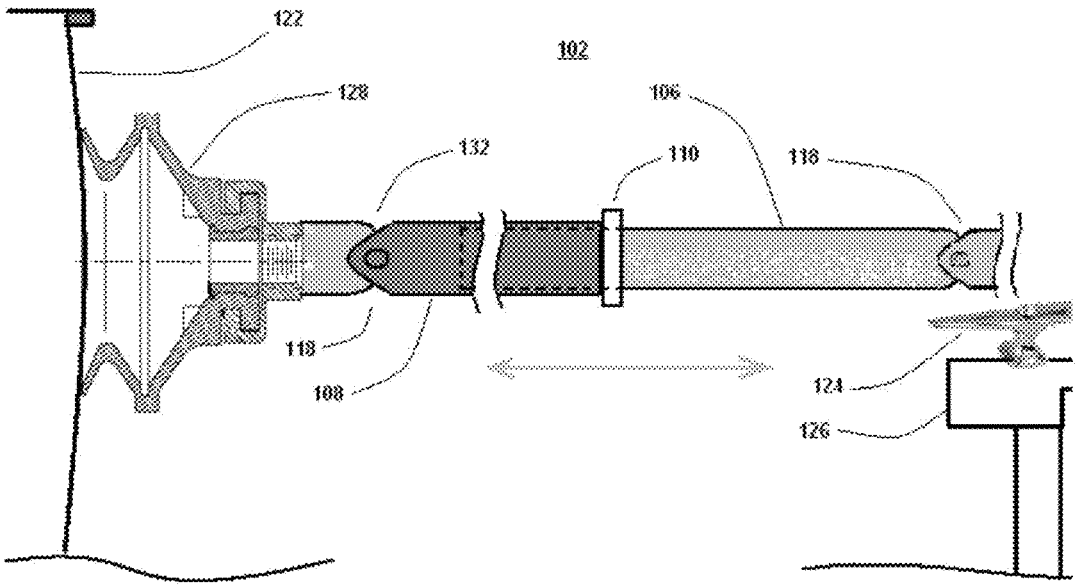
FIG. 6 is a cross sectional side view of the suction cup and mooring arm.

FIG. 6 illustrates, in more detail, an example of the suction cup mechanism 128 of FIG. 4. As illustrated in FIG. 6, the hull end of rigid mooring member 102 includes a suction cup attachment device 128 that is pivotally connected to member 108 by pivoting coupler 118. Pivoting coupler 118 includes clevis pin 132, which is inserted into the mating holes of suction cup 128 and outer member 108.

It is noted that any detachable means may be employed, such as a hook and eye or ball and socket to provide a flexure connection and is therefore not limited to the illustrated clevis pin embodiment.

Suction cup 128 provides a reliable connection point to hull 122 that will firmly hold mooring member 102 to the watercraft. The suction cup 128 can virtually connect to any accessible surface area of the hull or deck, which is relatively smooth. Suction cup 128 may include a manual vacuum actuator lever, which may provide a holding capacity sufficient to withstand twice the maximum force developed from the water/wind currents acting upon hull 122.

The other end of mooring member 102 comprises a dock attachment clamp which readily interfaces with cleat 124.

Figure 7:
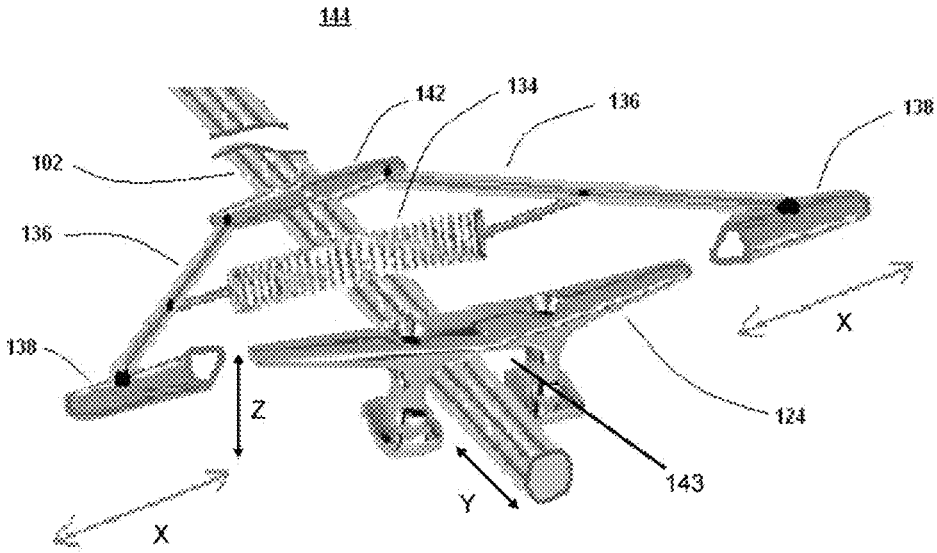
FIG. 7 is an isometric view of the pier cleat mooring arm retainer.

FIG. 7 illustrates a rigging 144 to attach a rigid mooring member to a docking via a conventional cleat 124. As illustrated in FIG. 7, the rigging 144 includes cleat sleeves 138 that go over the lateral extensions of the cleat 124. The cleat sleeves 138 are biased towards the cleat 124 via spring 134. Moreover, the cleat sleeves 138 are connected to a pole portion 102 of the rigid mooring member via arms 134 and cross member 142. The arms 134 are pivotally connected to the cross member 142. The cross member 142 engages the pole portion 102.

The pole portion 102 of the rigid mooring member is positioned in cleat opening 143 to allow vertical movement Z but restrict parallel horizontal movement X. The engagement of the cleat sleeves 138 over the lateral extensions of the cleat 124 restricts both orthogonal movement Y and parallel movement X. Thus, the rigging 144 allows vertical movement Z, but restricts both orthogonal movement Y and parallel movement X. so as to keep the watercraft in a standoff position with respect to the dock or pier.

It is noted that a smaller version of the rigging 144 can be used to connect the rigid mooring member to the cleats of a watercraft.

Dock attachment clamp 144 permits the watercraft to substantially move in unison with a floating pier or in the alternative to move up and down with the water undulations, independently of a fixed pier, and has negligible fore and aft motion.

Figure 5:
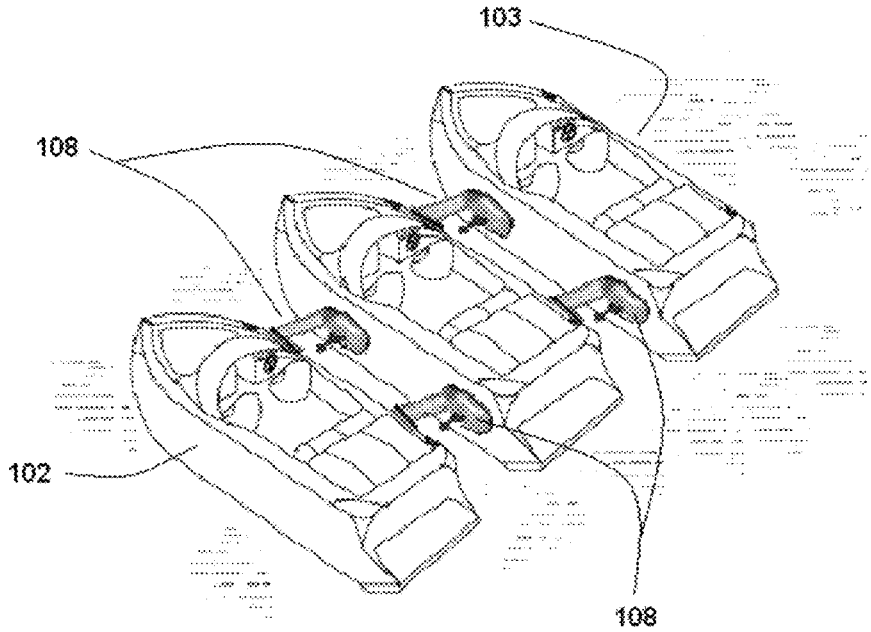
FIG. 5 is an isometric top down view of watercraft rafting with mooring arms.

In one embodiment, as seen in FIG. 5, rigid mooring member 102 has been adapted to include suction cup 128 on both the distal and proximal ends of member 102 using clevis pin 132. Boats 102 are now held in a fixed position relative to one another and accordingly are prohibited from coming into contact when two or more boats are rafting and yet are able to independently rise and fall with the motion of the waves and wind.

Figure 8:
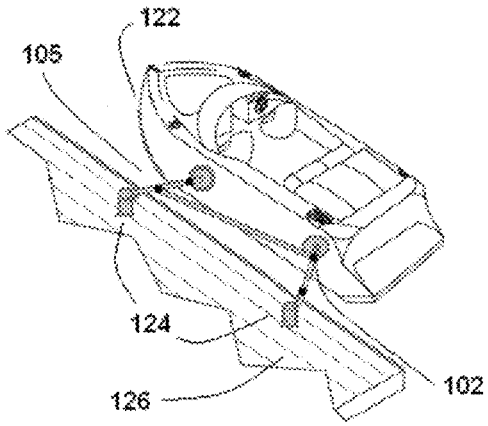
FIG. 8 is an isometric view of a tie-arm used with mooring arms.
Figure 9:
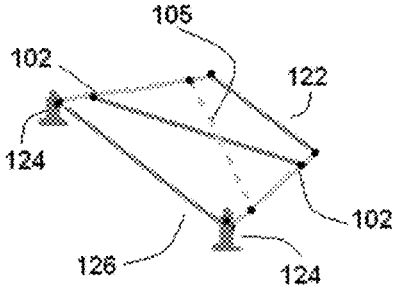
FIG. 9 is a vector diagram of the mooring elements of FIG. 8.

As illustrated in FIG. 8, an alternate method of mooring a watercraft is shown, whereby a pair of identical rigid members 102, are positioned such that the rigid members 102, in conjunction with dock 126 and hull 122, form a trapezoid, as illustrated in FIG. 9.

As illustrated in FIG. 9, the four sides of the trapezoid have no more than one pair of adjacent right angles and no more than two sides that are in parallel within the perimeter of the polygon defined by the dock, boat and the pair of rigid members 102. This configuration establishes the mooring geometry, however each connection point of the four sides remains an axis of rotation, and therefore the watercraft retains three degrees of freedom.

When a member is internally attached between two opposing corners or a combination of a corner and opposite side, substantial rigidity to the trapezoid is realized due to the four legs being in a fixed position relative to one another.

As illustrated in FIG. 9, adjustable pole 105 is inserted diagonally between the pair of rigid members 102 and thereby creating two triangles sharing a common side defined by adjustable pole 105, and effectively bracing each of the four legs in a fixed position relative to one another Adjustable pole 105 includes a distal and proximal connection hook that engages either end of rigid member 102. Members 102 include holes, or similar receivers, on either end so as they are interchangeable and allow pole 105 to connect in either direction.

Figure 12:
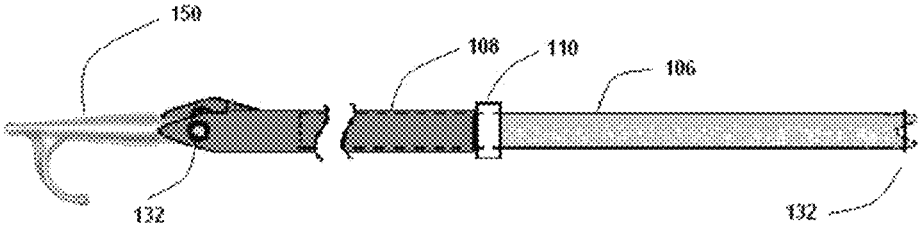
FIG. 12 is a planar view of the tie arm member used as a boat hook.

Extendable rigid member may provide further utility by attaching various appliances. For example, in FIG. 12, a hook 150 is attached to member 105 to be used as a boat hook when docking a boat.

Figure 13:
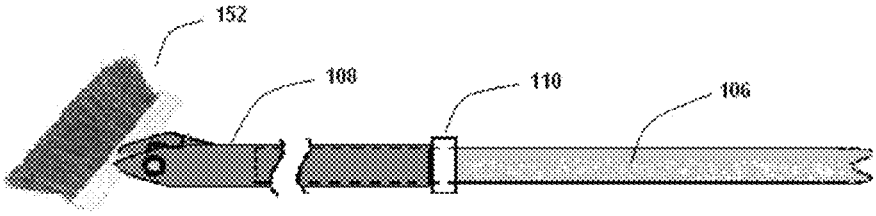
FIG. 13 is a planar view of the tie arm member used as a hull/deck brush.

Moreover, a brush, broom, or mop 152 may be readily attached to member 105 for on-board cleaning activities as illustrated in FIG. 13.

Figure 14:
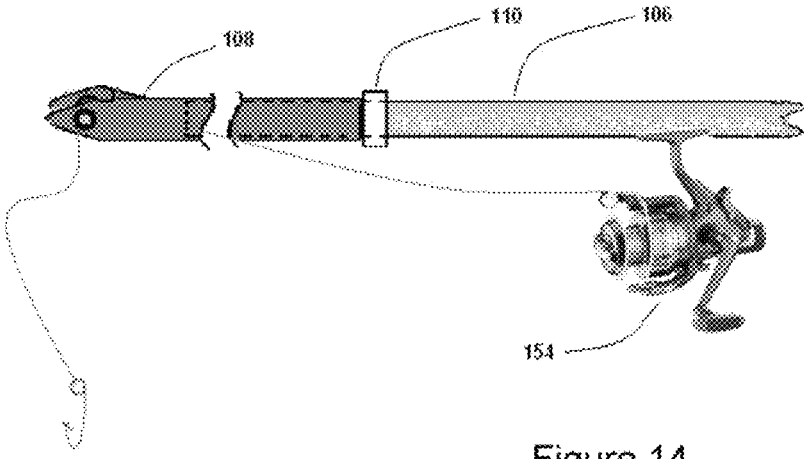
FIG. 14 is a planar view of the arm tie member used as a fishing pole.

In FIG. 14, a reel for fishing is attached to member 105.

Figure 15:
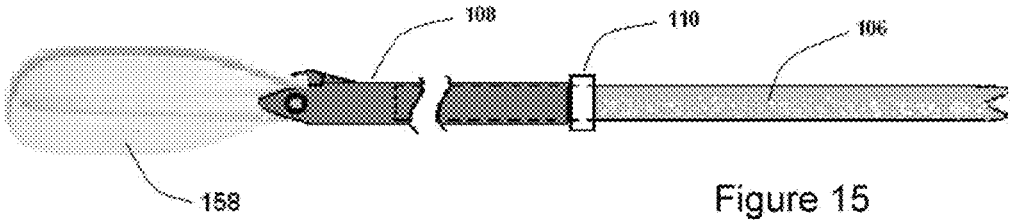
FIG. 15 is a planar view of the tie arm member used as a boat oar.

In FIG. 15, a paddle accessory is attached to member 105.

Figure 16:
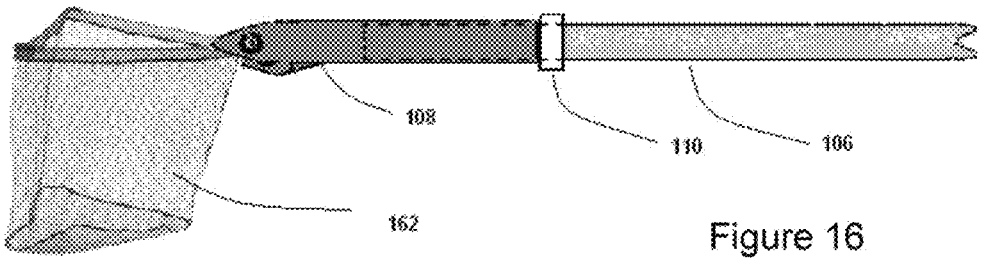
FIG. 16 is a planar view of the tie arm member used as a fishing net.

In FIG. 16, a fishing net is attached to member 105.

Figure 17:
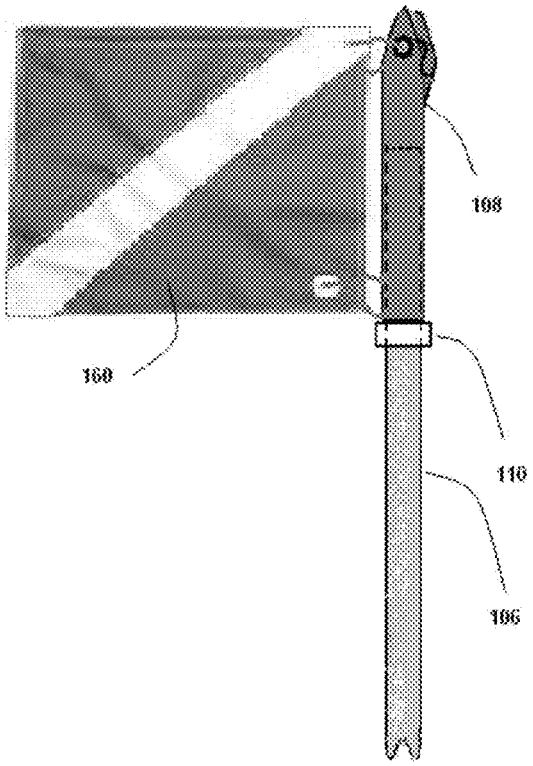
FIG. 17 is a planar view of the tie arm member used as a diving flag staff.

In FIG. 17, a "Divers Below" flag staff is attached to member 105.

Each of the aforementioned items include a common connection device whereas the accessory is engaged within a receiving socket of rigid member 105 having a quick release mechanism.

Figure 10:
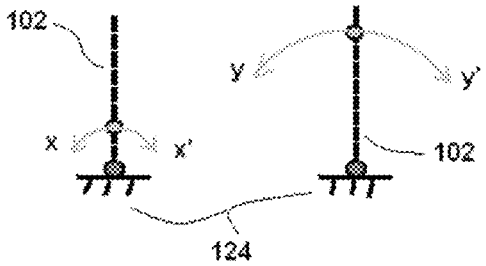
FIGS. 10 and 11 are moment diagrams of FIG. 8.

FIG. 10 illustrates a geometric relationship of the two mooring members. Given that the point of attachment x is essentially the center of a circle having x-x' as the radius and circle y has a radius of y-y', two distinctly different moments are realized.

For example, given two moments of the same length (x-x'=y-y') the points of attachment of the tie member would move in unison, and thereby allow the watercraft to move fore and aft. However, by providing inequities between the two radii, the two moment arms have dissimilar displacements.

Figure 11:
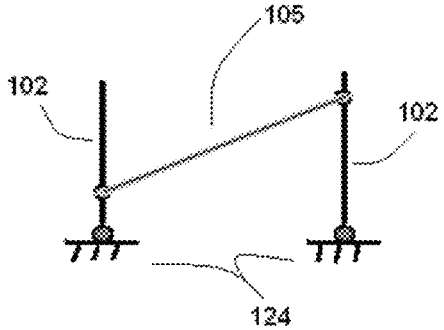

As illustrated in FIG. 10, radius y-y' moves in an arc that is larger than the displacement of the arc defined by x-x', causing disparity of displacement directly oppose any relative motion between rigid members 102 in the horizontal plane only. The tie bar 105 of FIG. 11 can reduce this disparity of displacement because the two mooring members are not required to have a "stiff" connection to either the dock or the watercraft.

It is noted that the rigid members may be used as either a permanent docking device or as a portable docking device and stored aboard the watercraft and used in the case of the rafting of two boats or mooring to an alternate dock.

The rigid member may be colored so as to be highly visible and readily located in the event of immediate avoidance maneuvers when docking.

In summary, a pair of rigid spacer members is used to separate a watercraft and its mooring by a specific distance, whereby each member has a boat-end and dock-end attachment fittings. The fittings are designed so as to be readily attachable to existing devices, such as cleats, hooks, or rails, or even directly to the hull of a boat or the deck of a dock, without any substantial alterations to either the dock or the watercraft.

It will be appreciated that various of the above-disclosed embodiments and other features and functions, or alternatives thereof, may be desirably combined into many other different systems or applications. Also, various presently unforeseen or unanticipated alternatives, modifications, variations or improvements therein may be subsequently made by those skilled in the art which are also intended to be encompassed by the following claims.

What is claimed is:

1. A device for maintaining separation between a watercraft and a pier, having mounted thereon a cleat, to which the watercraft is moored comprising:

a rigging including cleat sleeves for engaging lateral extensions of the cleat and a spring for biasing said cleat sleeves towards a center of the cleat;

a rigid mooring member having a first pivoting coupler and a second pivoting coupler, said first pivoting coupler being pivotally connectable to said rigging to prevent the watercraft from moving horizontally with respect to the pier and to allow movement of said rigid mooring member in a vertical direction with respect to the pier; and a detachable suction cup device pivotally connected to said second pivoting coupler of said rigid mooring member, the pivotal connection allowing movement of said detachable suction cup device in a vertical direction with respect to said rigid mooring member;

said detachable suction cup device being connectable to the watercraft to allow movement of the watercraft in a vertical direction with respect to the pier.

2. The device of claim 1, wherein said detachable suction cup device is pivotally connected to said second pivoting coupler of said rigid mooring member using a clevis pin.

* * * * *